US010636365B2

(12) United States Patent
Furihata et al.

(10) Patent No.: US 10,636,365 B2
(45) Date of Patent: Apr. 28, 2020

(54) DEVICE AND METHOD FOR IMAGE CORRECTION

(71) Applicant: SYNAPTICS INCORPORATED, San Jose, CA (US)

(72) Inventors: Hirobumi Furihata, Tokyo (JP); Susumu Saito, Tokyo (JP); Takashi Nose, Tokyo (JP)

(73) Assignee: SYNAPTICS INCORPORATED, San Jose, CA (US)

( * ) Notice: Subject to any disclaimer, the term of this patent is extended or adjusted under 35 U.S.C. 154(b) by 0 days.

(21) Appl. No.: 16/193,959

(22) Filed: Nov. 16, 2018

(65) Prior Publication Data

US 2019/0156763 A1 May 23, 2019

(30) Foreign Application Priority Data

Nov. 20, 2017 (JP) ..... 2017-223186

(51) Int. Cl.

| | |
|---|---|
| ***G09G 3/3275*** | (2016.01) |
| ***G09G 3/3233*** | (2016.01) |
| ***G09G 3/20*** | (2006.01) |

(52) U.S. Cl.

CPC ..... *G09G 3/3275* (2013.01); *G09G 3/20* (2013.01); *G09G 3/3233* (2013.01); *G09G 3/2007* (2013.01); *G09G 2310/0297* (2013.01); *G09G 2320/0233* (2013.01)

(58) Field of Classification Search

None

See application file for complete search history.

(56) References Cited

U.S. PATENT DOCUMENTS

| | | | | |
|---|---|---|---|---|
| 8,624,805 | B2 * | 1/2014 | McCreary | G09G 3/3233 345/80 |
| 9,818,373 | B2 * | 11/2017 | Ohta | G09G 3/3283 |
| 2007/0215888 | A1 * | 9/2007 | Mitsuhashi | G09G 3/3225 257/94 |
| 2019/0251900 | A1 * | 8/2019 | Min | G09G 3/3275 |

FOREIGN PATENT DOCUMENTS

| | | | |
|---|---|---|---|
| JP | 2006003880 | A | 1/2006 |
| JP | 2006163074 | A | 6/2006 |
| JP | 2007523377 | A | 8/2007 |

* cited by examiner

*Primary Examiner* — Duane N Taylor, Jr.

(74) *Attorney, Agent, or Firm* — Patterson + Sheridan, LLP

(57) ABSTRACT

A display driver comprises correction circuitry configured to correct a first image data for a first line, based on a difference between a first current and a second current. The first current is for displaying the first line and the second current is for displaying a second line after the first line is displayed.

25 Claims, 11 Drawing Sheets

| MUX DRIVE ORDER | CORRECTION AMOUNT |
|---|---|
| 1 | MUX CORRECTION #1 |
| 2 | MUX CORRECTION #2 |
| ⋮ | ⋮ |

DEVICE AND METHOD FOR IMAGE CORRECTION

CROSS REFERENCE

This application claims priority to Japanese Patent Application No. 2017-223186, filed on Nov. 20, 2017, the disclosure of which is incorporated herein by reference in its entirety.

BACKGROUND

Field

The present disclosure relates to a display driver, display device and method for image correction.

Description of the Related Art

Display panels such as liquid crystal display panels and organic light emitting diode display panels are used in electronic appliances such as notebook computers, desktop computers, and smart phones. When grayscale values of display data displayed on a display panel are changed, one or more visible defects may be generated within a displayed image due to variations in voltages supplied to the display panel.

SUMMARY

In one or more embodiments, a display driver comprises correction circuitry configured to correct a first image data for a first line to be displayed on a display panel, based on a difference between a first current and a second current. The first current is for displaying the first line and the second current is for displaying a second line after the first line is displayed.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

In the following, a detailed description is given of various embodiments with reference to the drawings. It would be apparent that technologies disclosed herein can be implemented by a person skilled in the art without a further detailed description of these embodiments. For simplicity, details of well-known features are not described in the following.

Figure 1A:
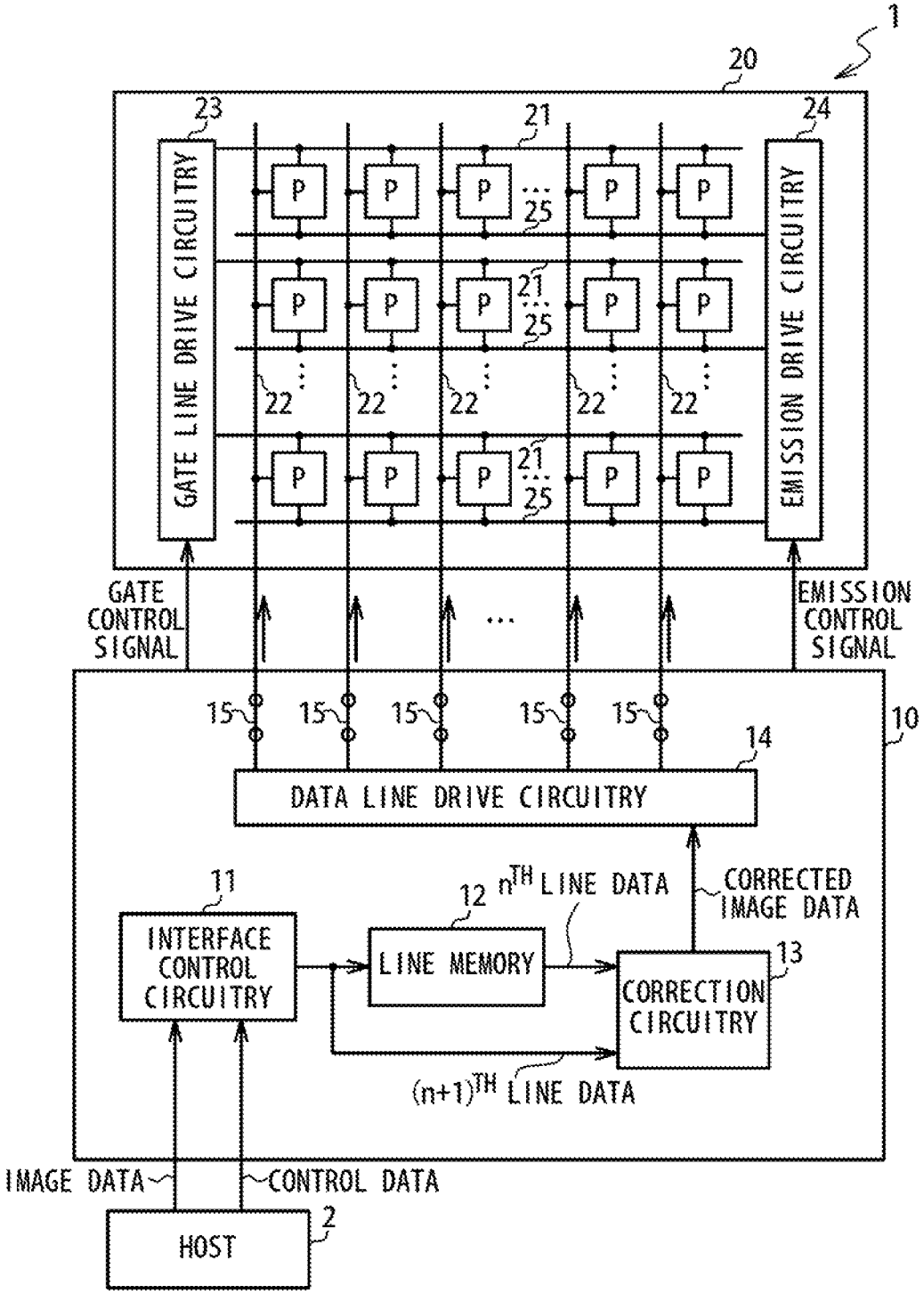
FIG. 1A is a block diagram illustrating an example configuration of a display device, according to one or more embodiments.

FIG. 1A is a block diagram illustrating the configuration of a display device 1 according to one or more embodiments. The display device 1 comprises a display driver 10 and a display panel 20.

The display device 1 may be configured to provide a user with information on the display panel 20. The display device 1 is one example electronic appliance equipped with a display panel. The electronic appliance may be a portable electronic appliance, such as a smart phone, a laptop computer, a netbook computer, a tablet, a web browser, an electronic book reader, and a personal digital assistant (PDA). The electronic appliance may be a device of any size and shape such as, a desktop computer including a display panel, and a display unit mounted on an automobile equipped with a display panel. The electronic appliance may be equipped with a touch sensor for touch sensing of an input object such as a user's finger and stylus.

Examples of the display panel 20 may include an organic light emitting diode (OLED) display panel and a liquid crystal display panel. In one or more embodiments, the display panel 20 comprises gate lines 21, data lines 22, gate line drive circuitry 23, emission drive circuitry 24, emission lines 25 and pixel circuits P.

Figure 1B:
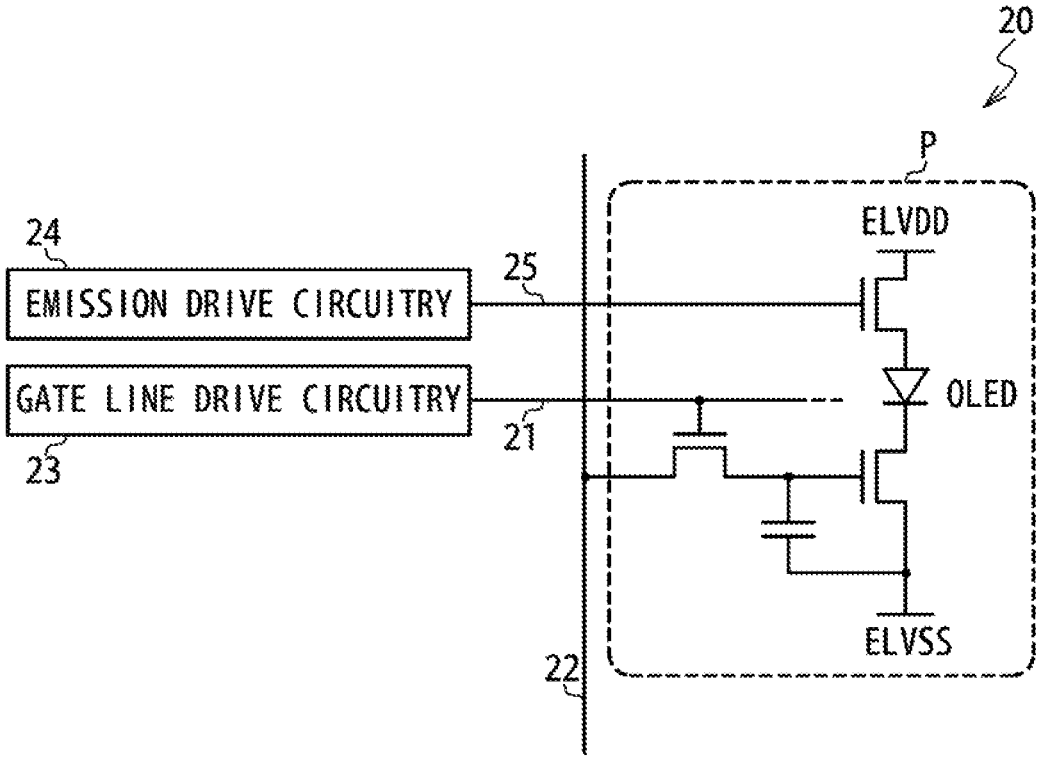
FIG. 1B is a block diagram illustrating an example configuration of a pixel circuit, according to one or more embodiments.

In one or more embodiments, as illustrated in FIG. 1B, each pixel circuit P, which is disposed at an intersection of a gate line 21 and a data line 22, is configured to display one of red, green and blue. Each pixel circuit P may also be connected to an emission line 25. In one embodiment, pixel circuits P displaying red, green and blue are used as an R subpixel, a G subpixel and a B subpixel, respectively.

In one or more embodiments, when an OLED display panel is used as the display panel 20, pixel circuits P displaying red, green and blue may comprise OLEDs which are light emitting elements configured to emit light of red, green and blue, respectively. In one or more embodiments, an OLED is configured to emit light when a potential difference is generated between a high-side power supply voltage ELVDD and a low-side power supply voltage ELVSS based on an emission signal received from the emission drive circuitry 24 to supply a current from the high-side power supply voltage ELVDD to the OLED.

Referring back to FIG. 1A, in one or more embodiments, the gate line drive circuitry 23 is configured to drive the gate lines 21 in response to gate control signals received from the display driver 10.

In one or more embodiments, the emission drive circuitry 24 is configured to drive the emission lines 25 in response to an emission control signal received from the display driver 10.

In one or more embodiments, the display driver 10 is configured to drive the display panel 20 in response to image data and control data received from a host 2 to display an image on the display panel 20. In one or more embodiments, the image data describe the grayscale values of the respective subpixels of each pixel of an original image to be displayed. In one or more embodiments, the control data comprise commands and parameters used to control the display driver 10.

Examples of the host 2 may include an application processor, a central processing unit (CPU) and a digital signal processor (DSP).

In one or more embodiments, the display driver 10 comprises interface control circuitry 11, a line memory 12, correction circuitry 13, data line drive circuitry 14 and multiplexer (MUX) 15.

In one or more embodiments, the interface control circuitry 11 is configured to transfer to the correction circuitry 13 image data received from the host 2. In one or more embodiments, the interface control circuitry 11 is configured to control circuitry integrated in the display driver 10 in response to commands included in the control data.

Figure 2:
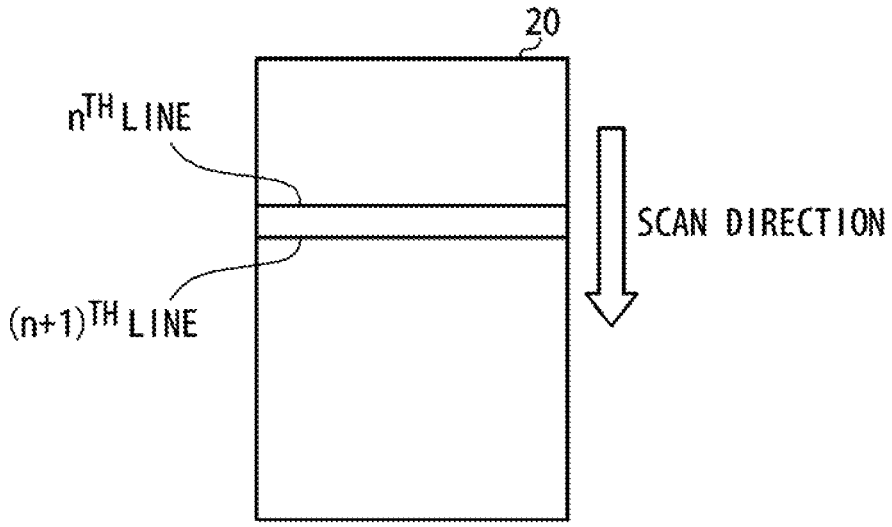
FIG. 2 illustrates example lines displayed on a display panel, according to one or more embodiments.

In one or more embodiments, the interface control circuitry 11 is configured to output to the line memory 12 image data for an $n^{th}$ line to be displayed on the display panel 20 and output to the correction circuitry 13 image data for an $(n+1)^{th}$ line to be next displayed after the $n^{th}$ line. The image data for the $n^{th}$ line may be also referred to as the $n^{th}$ line data. As illustrated in FIG. 2, after the $n^{th}$ line is displayed on the display panel 20, for example, the $(n+1)^{th}$ line positioned adjacent to the $n^{th}$ line in the scanning direction of the gate lines 21 is next displayed after the $n^{th}$ line is displayed.

In one or more embodiments, the line memory 12 is configured to store the image data received by the interface control circuitry 11. For example, a static random access memory (SRAM) may be used as the line memory 12. In one or more embodiments, the line memory 12 is configured to store image data, for example, for one line of the display panel 20 driven by the display driver 10.

The correction circuitry 13 is configured to perform desired image data processing on the image data received from the interface control circuitry 11.

In one or more embodiments, the correction circuitry 13 is configured to correct the image data used to drive the display panel 20, based on changes in a current flowing in the display panel 20 when respective line data are displayed. In one or more embodiments, for example, the correction circuitry 13 is configured to calculate a correction amount for the $n^{th}$ line data based on the $n^{th}$ line data read out from the line memory 12 and the $(n+1)^{th}$ line data to correct the $n^{th}$ line data. In one or more embodiments, the correction circuitry 13 is configured to output the corrected image data to the data line drive circuitry 14 to display the corrected image data on the display panel 20.

In one or more embodiments, the data line drive circuitry 14 is configured to drive the respective source lines 22 with source voltages corresponding to the grayscale values described in the corrected image data. Further, the MUXs 15 may be coupled to respective data lines 22. In one or more embodiments, source voltages are supplied to the data lines 22 when the MUXs 15 are driven. In one embodiment, the MUXs 15 are sequentially driven. In other embodiments, the MUXs 15 may be driven in other orders.

Figure 3:
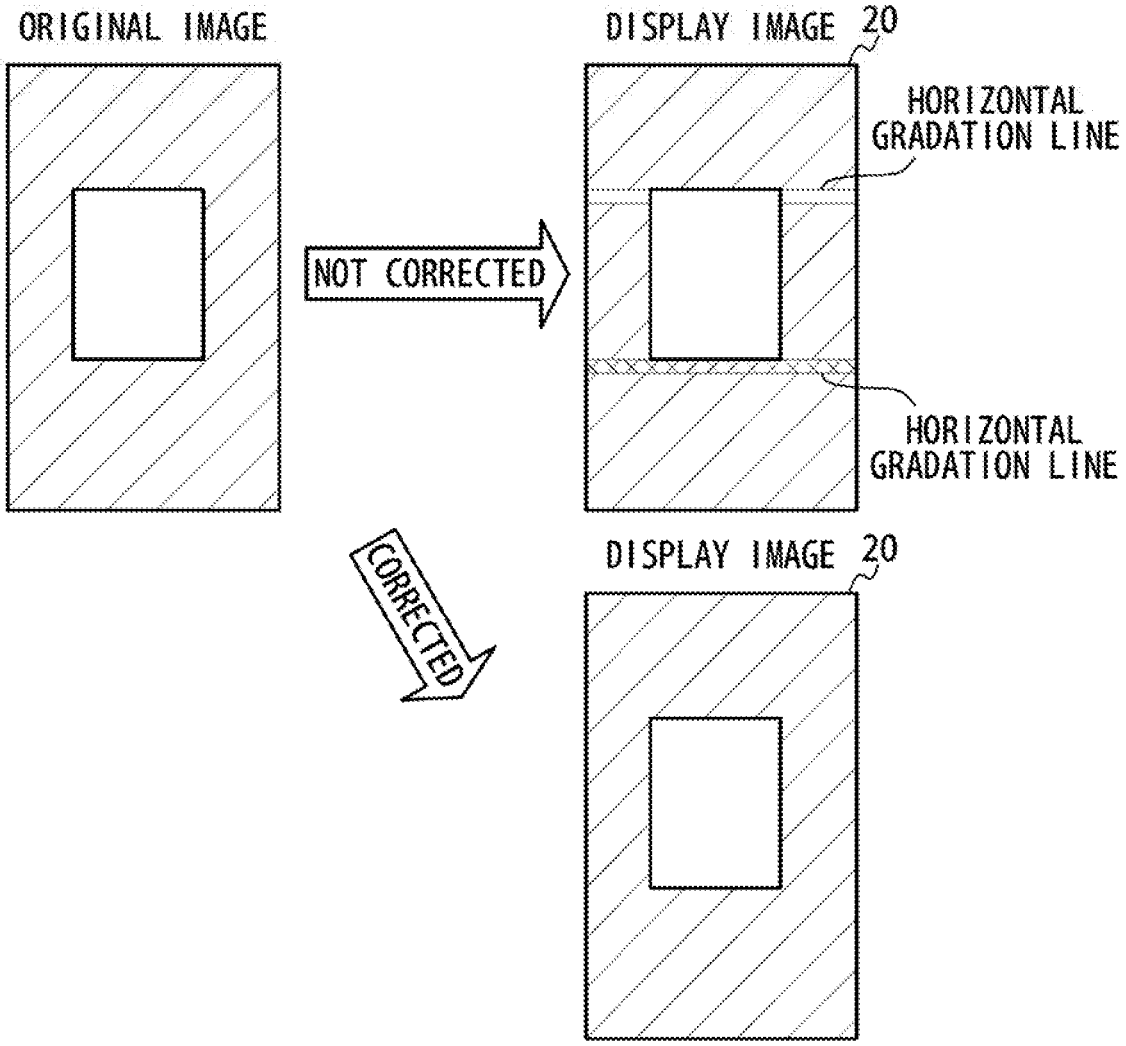
FIG. 3 schematically illustrates an example correction process of image data, according to one or more embodiments.

In one or more embodiments, an original image may include lines between which grayscale values are largely varied, for example, from gray to black, and, accordingly, the current flowing in the display panel 20 may be largely changed, resulting in variations in the power supply voltage ELVDD. In one or more embodiments, image data is displayed without generating horizontal gradation lines (pseudo lines) potentially resulting from variations in the high-side power supply voltage ELVDD, as illustrated in FIG. 3. To estimate variations in the power supply voltage ELVDD, which potentially causes generation of horizontal gradation lines, in one or more embodiments, an image correction process is performed to correct the $n^{th}$ line data to be displayed on the display panel 20, based on a difference in the current flowing in the display panel 20 between the case when the $n^{th}$ line data is displayed and the case when the $(n+1)^{th}$ line data is then displayed. In one or more embodiments, the difference in the current flowing in the display panel 20 is calculated, for example, as a difference in the average picture level (APL) by comparing an APL that is an average value of the brightness levels of the $n^{th}$ line data, with an APL of the $(n+1)^{th}$ line data, which is to be next displayed. A change in the power supply voltage ELVDD may cause influences on a plurality of lines in the display panel 20, and accordingly, the average value of APLs of line data associated with a predetermined number of line data older than the $(n+1)^{th}$ line data, for example, may be compared with the APL of the $(n+1)^{th}$ line data, in one or more embodiments. An influence on a plurality of lines caused by variations in the current flowing through the display panel 20 may be therefore suppressed.

Figure 4:
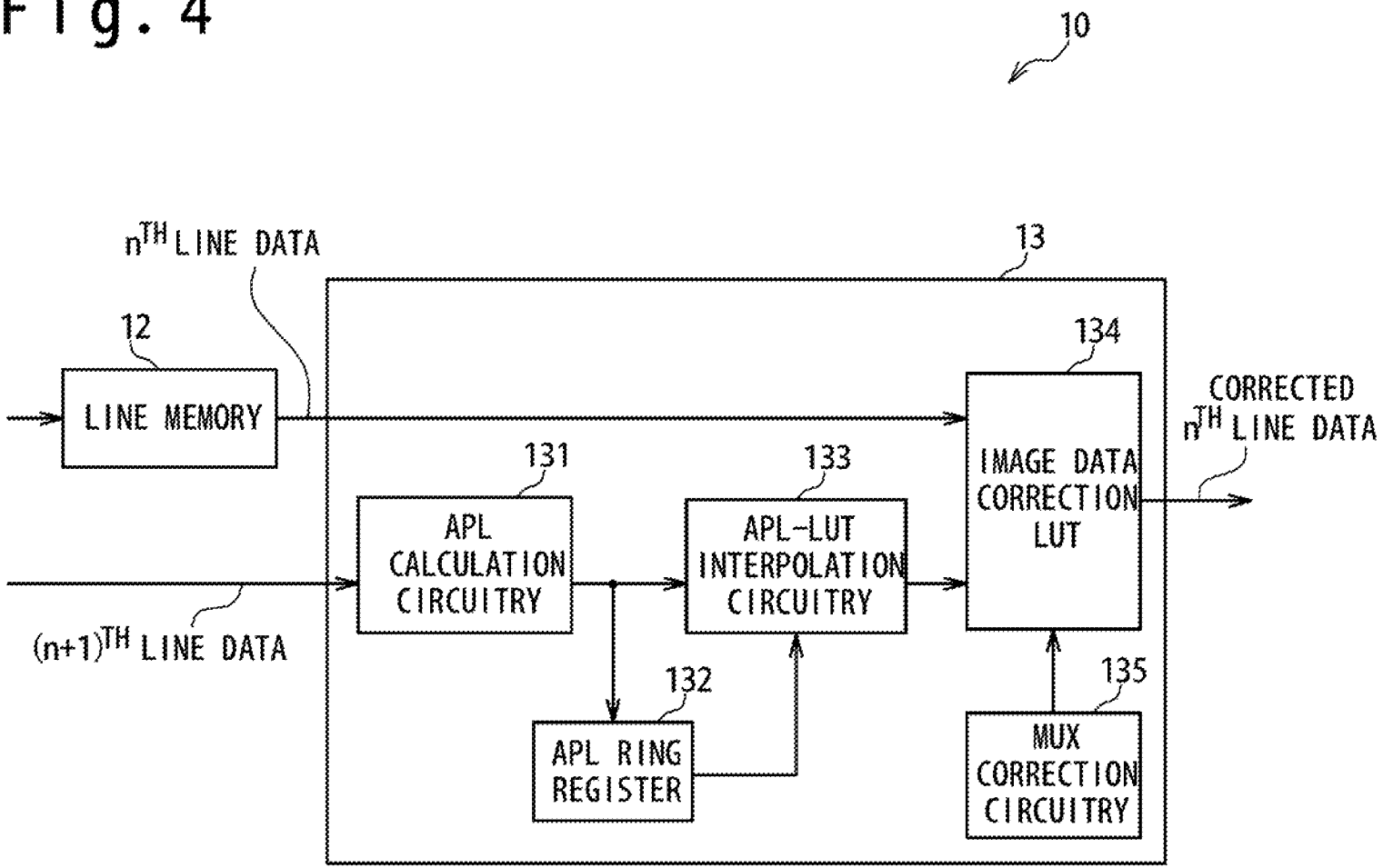
FIG. 4 is a block diagram illustrating an example configuration of correction circuitry, according to one or more embodiments.

FIG. 4 is a block diagram illustrating the configuration of the correction circuitry 13, according to one or more embodiments. In one or more embodiments, the correction circuitry 13 comprises APL calculation circuitry 131, an APL ring register 132, APL-lookup table (LUT) interpolation circuitry 133, an image data correction LUT 134, and MUX correction circuitry 135. In alternative embodiments, all or some of the APL calculation circuitry 131, an APL ring register 132, APL-LUT interpolation circuitry 133, an image data correction LUT 134 and MUX correction circuitry 135 may be integrated in the display driver 10 outside of the correction circuitry 13.

In one or more embodiments, the APL calculation circuitry 131 is configured to calculate APLs of a line data inputted thereto for the R, G and B subpixels and calculate the sum of the APLs. The APL indicates the average value of the brightness levels. In one or more embodiments, the APL calculation circuitry 131 is configured to calculate the APL of the $(n+1)^{th}$ line data to be displayed next. In one or more embodiments, the APL calculation circuitry 131 is configured to output the calculated APL to the APL ring register 132 and the APL-LUT interpolation circuitry 133.

The APL ring register 132 is configured to store the APLs of the $n^{th}$ and older line data. When receiving the APL of the $(n+1)^{th}$ line data, the APL ring register 132 deletes the APL of the oldest line data and stores the APL of the $(n+1)^{th}$ line data therein.

Figure 5:
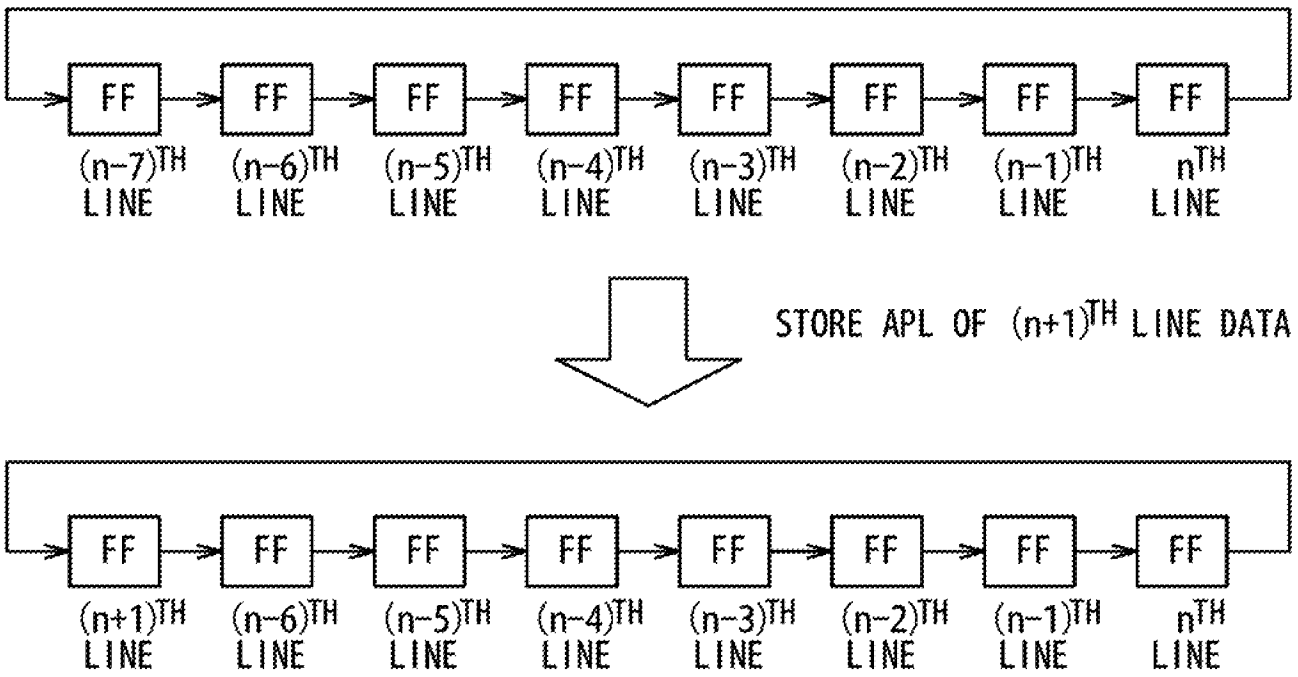
FIG. 5 illustrating an example configuration of an average picture level (APL) ring register, according to one or more embodiments.

FIG. 5 illustrates an example configuration of the APL ring register 132 according to one or more embodiments. In one or more embodiment, as illustrated in the upper section of FIG. 5, the APL ring register 132 stores, for example, the APLs of the $(n-7)^{th}$ to $n^{th}$ line data by using flipflops before the APL of the $(n+1)^{th}$ line data is inputted to the APL ring register 132.

When the APL of the $(n+1)^{th}$ line data is then inputted to the APL ring register 132, as illustrated in the lower section of FIG. 5, the APL ring register 132 stores the APL of the $(n+1)^{th}$ line data in place of the APL of the $(n-7)^{th}$ line data, which is the oldest. Although FIG. 5 illustrates one example in which the APL ring register 132 stores the APLs of eight line data in total, the number of APLs of the line data stored in the APL ring register 132 may be one or more.

The image data correction LUT 134 is configured to store correction amounts of line data for the difference between the average value of APLs of a predetermined number of line data older than the $(n+1)^{th}$ line data and the APL of the $(n+1)^{th}$ line data, which is displayed after the $n^{th}$ line data to be displayed next.

Figures 6, 7:
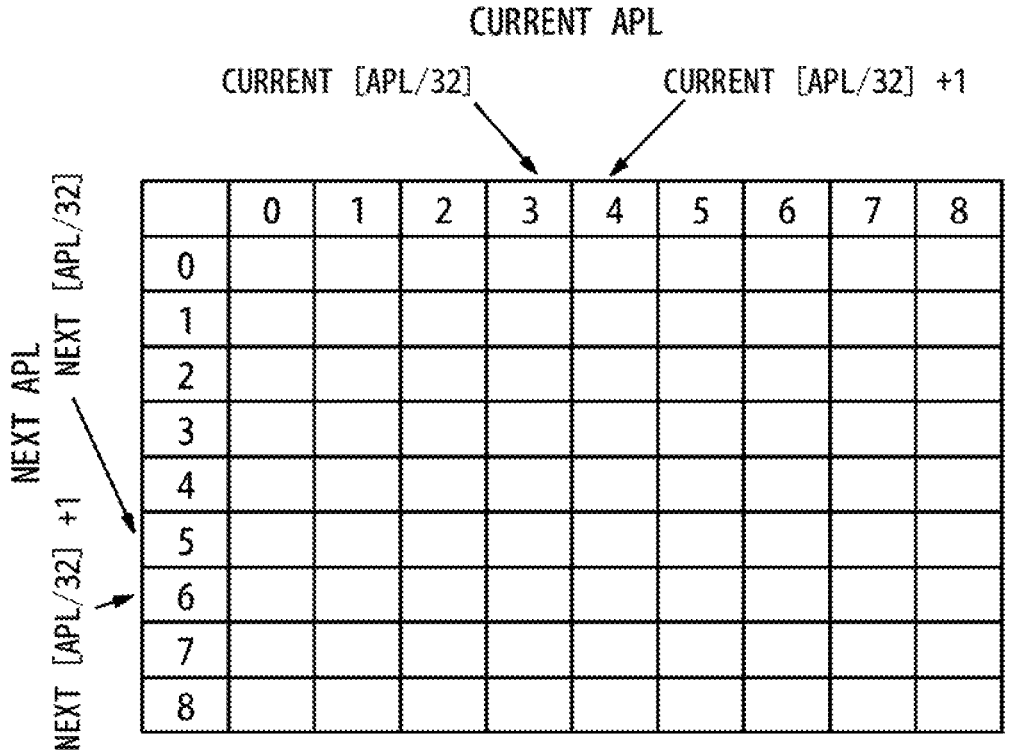
FIG. 6 illustrates an example configuration of an image data correction lookup table (LUT), according to one or more embodiments.
FIG. 7 illustrates an example configuration of a multiplexer (MUX) correction LUT, according to one or more embodiments.

In one or more embodiments, as illustrated in FIG. 6, in the image data correction LUT 134, the current APL, which is horizontally depicted in FIG. 6, represents the average value of the APLs of the $n^{th}$ line data and the older line data. In one or more embodiments, the next APL, which is vertically depicted in FIG. 6, represents the APL of the $(n+1)^{th}$ line data. In one or more embodiments, the image data correction LUT 134 indicates correction amounts for the current APL and the next APL.

Referring back to FIG. 4, in one or more embodiments, the APL-LUT interpolation circuitry 133 is configured to calculate the difference between the APL of the $(n+1)^{th}$ line data, which is to be displayed next after the $n^{th}$ line data, and the average value of the APLs of a plurality of line data which are displayed before the $(n+1)^{th}$ line data is displayed.

In one embodiment, when the APLs of the first to fifth line data #0 to #4 are 100, 100, 100, 0 and 0, respectively, and a change in the power supply voltage ELVDD potentially influences two lines, for example, the APL-LUT interpolation circuitry 133 operates as follows in one or more embodiments. In this case, the average value of the APLs of two line data is calculated in view of the fact that a change in the power supply voltage ELVDD potentially influences two lines.

In one embodiment, when n=2, that is, the second line data #1 is to be next displayed, the APL-LUT interpolation circuitry 133 calculates the difference between the average value of the APLs of the first and second line data #0 and #1 and the APL of the third line data #2, where the average of the APLs of the first and second line data #0 and #1 is "100" (=(100+100)/2), and the APL of the third line data #2 is "100". In such an embodiment, the difference is "0" and therefore the correction amount is calculated as "0".

In one embodiment, when n=3, that is, the third line data #2 is to be next displayed, the APL-LUT interpolation circuitry 133 calculates the difference between the average of the APLs of the second and third line data #1 and #2 and the APL of the fourth line data #3, where the average value of the APLs of the second and third line data #1 and #2 is "100" (=(100+100)/2) and the APL of the fourth line data #3 is "0". In such an embodiment, the difference is "100", and therefore the correction amount is determined as a data associated with a current APL of "100" and a next APL of "0" in the image data correction LUT 134.

In one embodiment, when n=4, that is, the fourth line data #3 is to be next displayed, the APL-LUT interpolation circuitry 133 calculates the difference between the average value of the APLs of the third and fourth line data #2 and #3 and the APL of the fifth line data #4, where the average of the APLs of the third and fourth line data #2 and #3 is "50" (=(100+0)/2) and the APL of the fifth line data #4 is "0". In such an embodiment, the difference is "50", and therefore the correction amount is determined as a data associated with a current APL of "50" and a next APL of "0" in the image data correction LUT 134. As thus described, in one or more embodiments, correction amounts are sequentially calculated for respective lines.

In one or more embodiments, the MUX correction circuitry 135 is configured to calculate a correction amount based on the order of driving by the MUXs 15 and output the same to the APL-LUT interpolation circuitry 133. In one or more embodiment, the MUX correction circuitry 135 may comprise an LUT which correlates the order of driving by the MUXs 15 with correction amounts, as illustrated in FIG. 7.

Figure 8A:
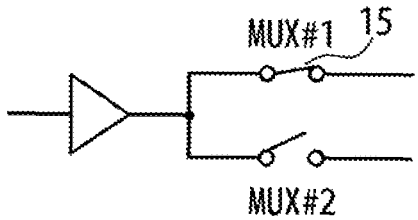
FIG. 8A illustrates an example configuration of a MUX, according to one or more embodiments.
Figure 8B:
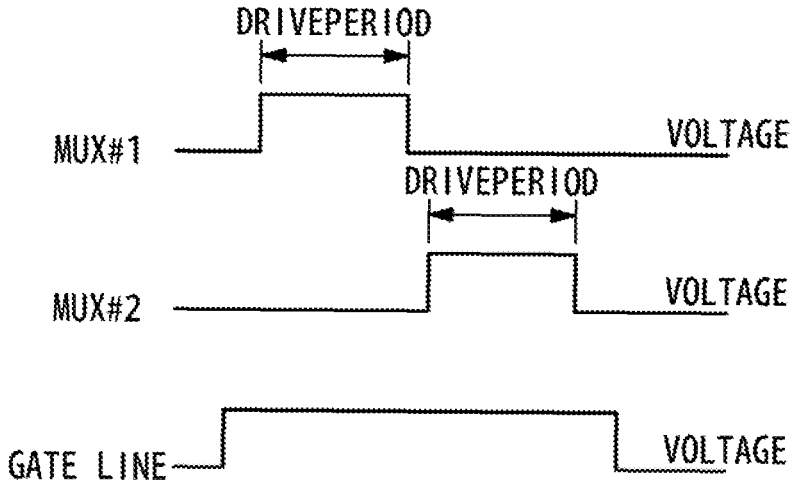
FIG. 8B illustrates an example operation of the MUX, according to one or more embodiments.

In various embodiments, when the multiplexers 15 comprise multiplexers #1 and #2 as illustrated in FIG. 8A, for example, the MUX #1 transmits a voltage to a data line 22 and then the MUX #2 transmits a voltage to another data line 22 as illustrated in FIG. 8B. In one or more embodiments, various processes, including emission line driving and threshold voltage cancelling of transistors configured to drive OLEDs, are performed before the voltage transmission by the MUX #1, for example, and this may make the drive time of the MUX #1 insufficient. Accordingly, in one or more embodiments, image data are corrected based on the order of driving by the multiplexers 15 to achieve correction against variations in the power supply voltage ELVDD depending on the order of driving of the multiplexers. In one or more embodiments, when the order of driving of the multiplexers 15 is inputted to the MUX correction circuitry 135, the MUX correction circuitry 135 calculates a correction amount adapted to the order of driving of the multiplexers 15, based on the LUT illustrated in FIG. 7. In one or more embodiments, a correction amount determined based on the order of driving of the multiplexers 15 may be indicated as a weighting factor used for weighting on the correction amount calculated in the APL-LUT interpolation circuitry 133.

Figure 9:
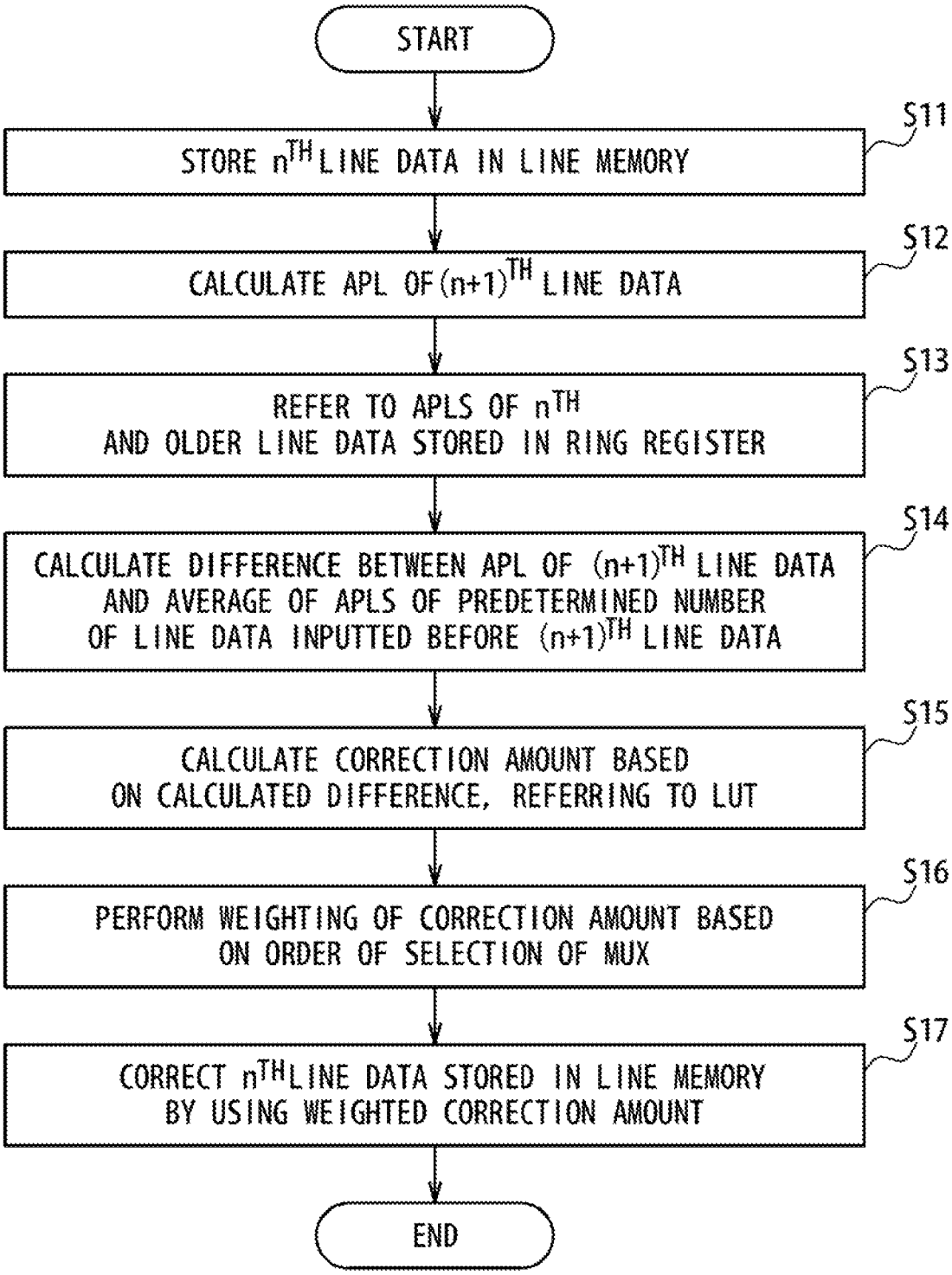
FIG. 9 illustrates an example correction process flow of image data.

In one or more embodiments, a correction process of image data is performed in the display driver 10 as illustrated in FIG. 9.

In one or more embodiments, at step S11, the $n^{th}$ line data is stored in the line memory 12.

In one or more embodiments, at step S12, the APL calculation circuitry 131 calculates the APL of the $(n+1)^{th}$ line data to be next displayed.

In one or more embodiments, at step S13, the APL-LUT interpolation circuitry 133 refers to the APLs of the $n^{th}$ line data and the older line data stored in the APL ring registers 132, and at step S14, the APL-LUT interpolation circuitry 133 calculates the difference between the APL of the $(n+1)^{th}$ line data and the average value of the APLs of a predetermined number of line data older than the $(n+1)^{th}$ line data.

In one or more embodiments, at step S15, the correction amount is calculated for the calculated difference in the image data correction LUT 134.

In one or more embodiments, at step S16, the MUX correction circuitry 135 performs weighting of the correction amount calculated in the image data correction LUT 134, based on the order of driving by the multiplexers 15. In one or more embodiments, at step S17, the $n^{th}$ line data stored in the line memory 12 is corrected by using the correction amount obtained by the weighting at step S16 and the corrected line data is outputted.

In one or more embodiments, an image data correction process is performed depending on the panel structure. In one or more embodiments, with respect to an OLED display panel, for example, pixels of input image data may be mapped to pseudo pixels by subpixel rendering (SPR) and the resultant output image may be displayed on the OLED display panel. In one embodiment, when pixel data is mapped to the image structure in the SPR, one line of a display data may be represented by a plurality of lines (e.g. two lines).

Figure 10:
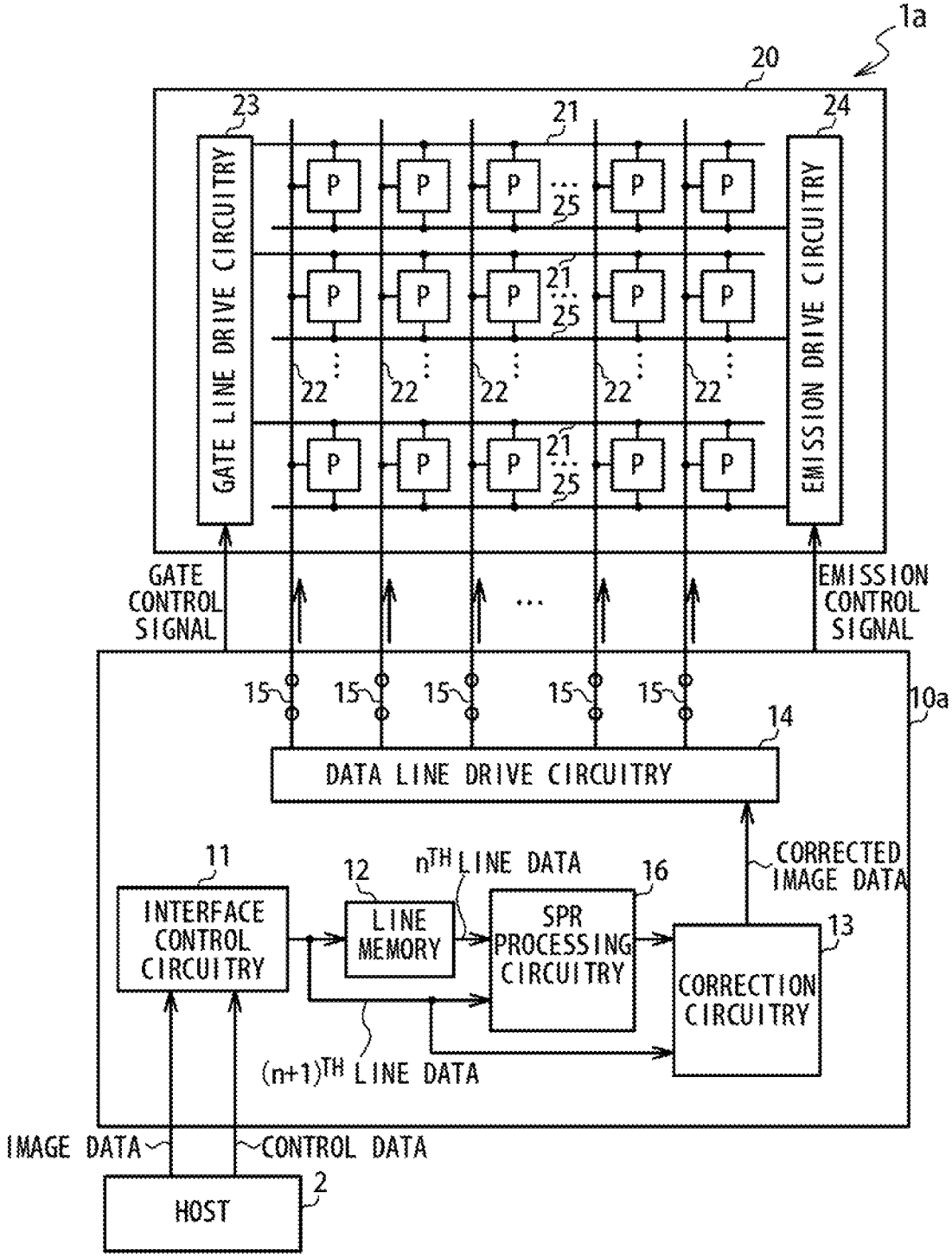
FIG. 10 is a block diagram illustrating an example configuration of a display device, according to one or more embodiments.

FIG. 10 is a block diagram illustrating a variation configuration of a display device la in one or more embodiments. In one or more embodiments, in the display device la illustrated in FIG. 10, the display driver 10*a* comprises SPR processing circuitry 16, differently from the display device 1 illustrated in FIG. 1A. In one or more embodiments, one line memory 12 is shared by the SPR processing circuitry 16 and the correction circuitry 13 in the display device 1*a*. The SPR processing circuitry 16 converts a plurality of input lines of input image data into one line. In FIG. 10, same components incorporated in the above-described display device 1 are denoted by the same reference numerals, and a detailed description is not given.

In the following, a description is given of an example in which a line data for one line in the displayed image is generated through SPR processing from line data for two lines of the input image. In one or more embodiments, when the average value of the APLs of a predetermined number of line data displayed before the line data to be next displayed is calculated, the APLs are calculated from line data for two lines of the input image, one of the two lines being overlapped for two APLs successively calculated.

Figure 11:
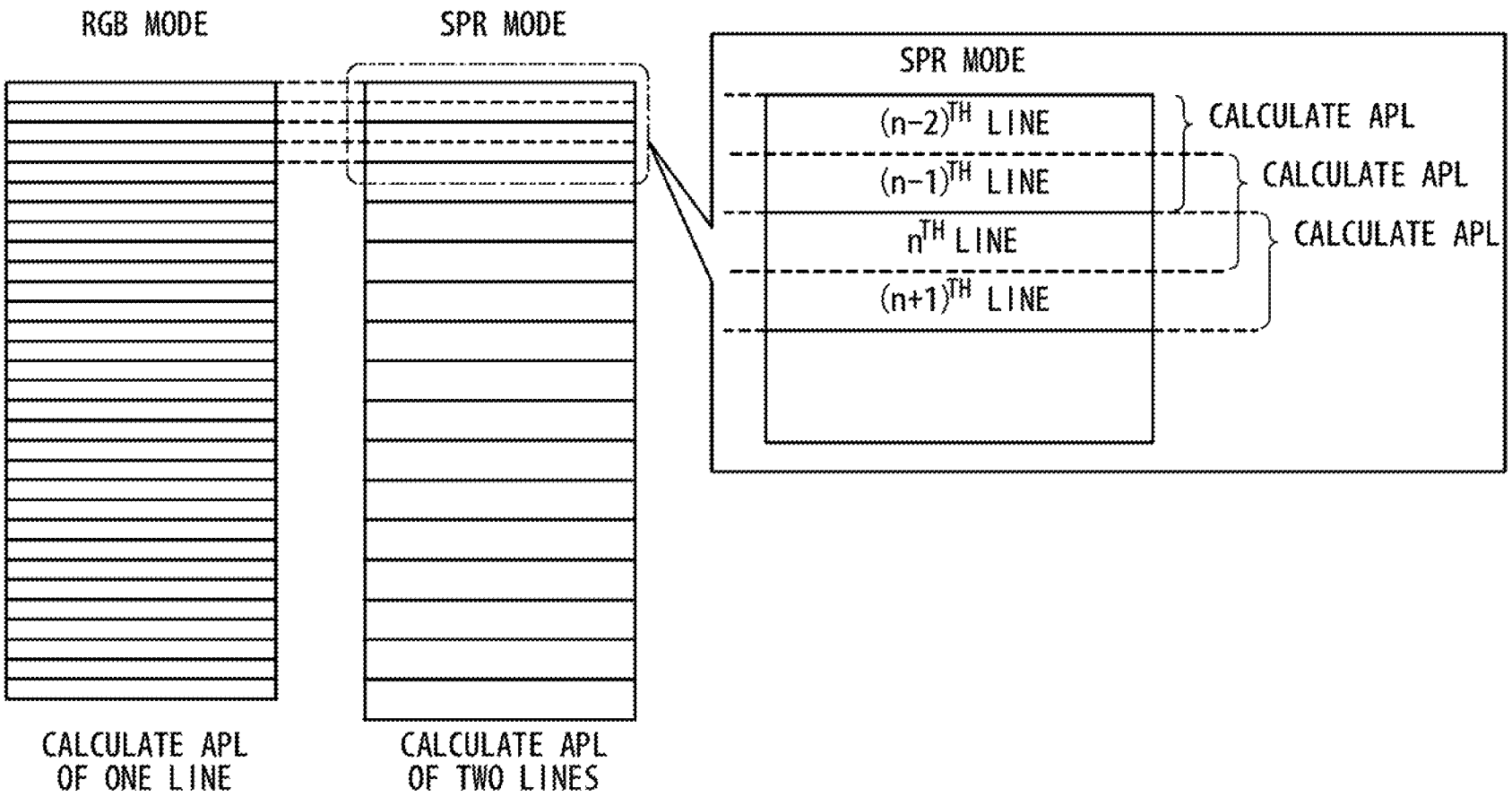
FIG. 11 illustrates one example of an APL calculation method in a subpixel rendering (SPR) mode, according to one or more embodiments.

FIG. 11 illustrates an example method for calculating the APLs in one or more embodiments. As illustrated in FIG. 11, an APL is calculated for each line in a RGB mode. In an SPR mode, in one or more embodiments, an APL of every adjacent two lines of the original input image, which is not yet subjected to the SPR, is calculated. In one or more embodiments, when a line data for a line obtained through the SPR from $n^{th}$ and $(n+1)^{th}$ line data of input image is to be next displayed and a change in the power supply voltage influence two lines of the displayed image, the average value of the APLs of the line data older than the line data to be next display is calculated as the average value of the APL of the line data for the line of interest and the average value of the APL of the $n^{th}$ and $(n-1)^{th}$ line data and the APL of the $(n-1)^{th}$ and $n^{th}$ line data. In the example illustrated in FIG. 11, the $(n-1)^{th}$ line data is used for calculating two APLs; the two APLs are calculated for the two sets each including two lines shifted by one line. As thus described, in one or more embodiments, the APL-LUT interpolation circuitry 133 may be configured to calculate an APL of image data displayed before the line to be next displayed based on a predetermined number of input lines of the input image data, which are incrementally shifted by one line in the opposite direction of the scan direction from a plurality of lines of the input image which is converted into a line to be next displayed.

In one or more embodiments, the above-described method of calculating APLs in units of two lines and the method of calculating APLs for each line may be selectively used in one display driver.

Although a limited number of embodiments have been described in the above, a skilled person benefitted from this disclosure would appreciate that various other embodiments and variations may be conceived without departing from the scope of this disclosure. Embodiments and variations may be combined. Accordingly, the specification and drawings only provides an exemplary disclosure.

What is claimed is:

1. A display driver comprising:

correction circuitry configured to correct first image data for a first line to be displayed on a display panel based on a difference between a first current and a second current, wherein the first current is for displaying the first line and the second current is for displaying a second line after the first line is displayed.

2. The display driver according to claim 1, wherein correcting the first image data based on the difference between the first current and the second current comprises correcting the first image data for the first line based on a difference between a first average picture level (APL) of a second image data for the second line and a second APL of a third image data for a third line, wherein the third line is displayed before the second line is displayed.

3. The display driver according to claim 2, the correction circuitry comprises a lookup table configured to store correction amounts for the difference between the first APL and the second APL, wherein correcting the first image data based on the difference between the first APL and the second APL comprises correcting the first image data based on the correction amounts.

4. The display driver according to claim 1, wherein correcting the first image data based on the difference between the first current and the second current comprises correcting the first image data for the first line based on a difference between an average picture level (APL) of a second image data for the second line and an average value of APLs of image data for a plurality of lines, wherein the plurality of lines are displayed before the second line is displayed.

5. The display driver according to claim 4, the correction circuitry comprises a lookup table configured to store correction amounts for the difference between the APL of the second image data for the second line and the average value of the APLs of the image data for the plurality of lines, wherein correcting the first image data based on the difference between the APL of the second image data for the second line and the average value of APLs of image data for the plurality of lines comprises correcting the first image data based on the correction amounts.

6. The display driver according to claim 5 further comprising:

interpolation circuitry configured to calculate the difference between the APL of the second image data for the second line and the average value of the APLs of the image data for the plurality of lines, wherein the lookup table is further configured to calculate a calculated correction amount based on the stored correction amounts and the calculated difference.

7. The display driver according to claim 1 further comprising:

average picture level (APL) calculation circuitry configured to calculate APLs of image data for respective lines; and a register configured to store the calculated APLs of the image data for the respective lines.

8. The display driver according to claim 7 further comprising:

multiplexers configured to drive a plurality of data lines of the display panel, and wherein the correction circuitry is further configured to correct the first image data for the first line based on an order of driving the plurality of data lines with the multiplexers.

9. The display driver according to claim 7, wherein the APL calculation circuitry is configured to, when a first set of lines of input image data is converted into the first line to be displayed on the display panel, calculate an APL of the input image data for the first set of lines, wherein correcting the first image data based on the difference between the first current and the second current comprises correcting the first image data for the first line based on the calculated APL of the input image data for the first set of lines.

10. The display driver according to claim 9, wherein correcting the first image data for the first line comprises correcting the first image data for the first line based on a difference between the calculated APL of the input image data and an APL of a second image data for the second line.

11. The display driver according to claim 9, wherein the APL calculation circuitry is configured to, when a second set of lines of the input image data is converted into the second line, calculate an APL of the input image data for the second set of lines, wherein the second set of lines is incrementally shifted from the first set of lines by one line, wherein correcting the first image data for the first line comprises correcting the first image data for the first line based on the calculated APLs of the input image data for the first and second sets of lines.

12. The display driver according to claim 11, wherein correcting the first image data for the first line comprises correcting the first image data for the first line based on the calculated APL of the input image data for the second set of lines and an average value of APLs of the input image data for the first set of lines and a third set of lines, wherein the first set of lines is incrementally shifted from the third set of lines by one line.

13. The display driver according to claim 9 further comprising:

a line memory configured to store at least one line of the first set of lines.

14. A display device comprising:

a display panel; and a display driver configured to display image data on the display panel, wherein the display driver comprises:

correction circuitry configured to correct a first image data for a first line to be displayed on the display panel based on a difference between a first current and a second current, wherein the first current is for displaying the first line and the second current is for displaying a second line after the first line is displayed.

15. The display device according to claim 14, wherein correcting the first image data based on the difference between the first current and the second current comprises correcting the first image data for the first line based on a difference between an average picture level (APL) of a second image data for the second line and an APL of a third image data for a third line, wherein the third line is displayed before the second line.

16. The display device according to claim 14, wherein correcting the first image data based on the difference between the first current and the second current comprises correcting the first image data for the first line based on a difference between an average picture level (APL) of a second image data for the second line and an average value of APLs of image data for a plurality of lines displayed before the second line is displayed.

17. The display device according to claim 14 further comprising:

multiplexers connected to a plurality of data lines of the display panel, wherein the correction circuitry is configured to correct the first image data for the first line in response to an order of driving the plurality of the data lines with the multiplexers.

18. The display device according to claim 14, wherein the correction circuitry is further configured to calculate an average picture level (APL) of input image data for a first set of lines when a first set of lines of the input image data is converted into the first line to be displayed on the display panel, wherein correcting the first image data based on the difference between the first current and the second current comprises correcting the first image data for the first line based on the calculated APL of the input image data for the first set of lines.

19. The display device according to claim 18, wherein the correction circuitry is further configured to calculate an APL of input image data for a second set of lines when a second set of lines of the input image data is converted into the second line, wherein the second set of lines is incrementally shifted from the first set of lines by one line, and wherein correcting the first image data for the first line comprises correcting the first image data for the first line based on the calculated APLs of the input image data for the first and second sets of lines.

20. An image correction method comprising:

correcting a first image data for a first line to be displayed on a display panel based on a difference between a first current and a second current, wherein the first current is for displaying the first line and the second current is for displaying a second line after the first line is displayed.

21. The image correction method according to claim 20, wherein correcting the first image data for the first line comprises correcting the first image data for the first line based on a difference between an average picture level (APL) of a second image data for the second line and an APL of a third image data for a third line, wherein the third line is displayed before the second line is displayed.

22. The image correction method according to claim 20, wherein correcting the first image data for the first line comprises correcting the first image data for the first line based on a difference between an average picture level (APL) of a second image data for the second line and an average value of APLs of image data for a plurality of lines, wherein the plurality of lines are displayed before the second line is displayed.

23. The image correction method according to claim 20, further comprising:

wherein correcting the first image data for the first line comprises correcting the first image data for the first line based on an order of driving a plurality of a data lines.

24. The image correction method according to claim 20 further comprising:

calculating an average picture level (APL) of a input image data for a first set of lines based on a conversion of the first set of lines of the input image data into the first line to be displayed on the display panel, wherein correcting the first image data for the first line comprises correcting the first image data for the first line based on the calculated APL of the input image data for the first set of lines.

25. The image correction method according to claim 24 further comprising:

calculating an APL of input image data for a second set of lines based on a conversion of the second set of lines of the input image data into the second line, wherein the second set of lines is incrementally shifted from the first set of lines by one line, wherein correcting the first image data for the first line comprises correcting the first image data for the first line based on the calculated APLs of the input image data for the first and second sets of lines.

* * * * *